US011715882B2

(12) United States Patent
Rogers

(10) Patent No.: US 11,715,882 B2
(45) Date of Patent: Aug. 1, 2023

(54) LOW-PROFILE MAGNETIC ANTENNA ASSEMBLIES

(71) Applicant: THE BOEING COMPANY, Chicago, IL (US)

(72) Inventor: John E. Rogers, Huntsville, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 17/471,292

(22) Filed: Sep. 10, 2021

(65) Prior Publication Data

US 2022/0216614 A1 Jul. 7, 2022

Related U.S. Application Data

(60) Provisional application No. 63/133,307, filed on Jan. 2, 2021.

(51) Int. Cl.

| | |
|---|---|
| ***H01Q 15/00*** | (2006.01) |
| ***H01Q 1/28*** | (2006.01) |
| ***H01Q 9/04*** | (2006.01) |
| ***H01Q 21/06*** | (2006.01) |

(52) U.S. Cl.

CPC ..... *H01Q 15/004* (2013.01); *H01Q 1/286* (2013.01); *H01Q 9/0457* (2013.01); *H01Q 21/065* (2013.01)

(58) Field of Classification Search

CPC .... H01Q 1/286; H01Q 9/0457; H01Q 21/065; H01Q 1/36; H01Q 15/004

See application file for complete search history.

(56) References Cited

U.S. PATENT DOCUMENTS

| | | | | |
|---|---|---|---|---|
| 4,719,470 A * | 1/1988 | Munson | ..... | H01Q 9/065 343/834 |
| 5,589,842 A * | 12/1996 | Wang | ..... | H01Q 25/04 343/895 |
| 6,087,989 A * | 7/2000 | Song | ..... | H01Q 21/08 343/803 |
| 6,266,016 B1 * | 7/2001 | Bergstedt | ..... | H05K 1/0245 343/848 |

(Continued)

FOREIGN PATENT DOCUMENTS

| | | | | |
|---|---|---|---|---|
| CN | 106340727 A * | 1/2017 | ..... | H01Q 1/48 |

OTHER PUBLICATIONS

Rogers Corp., Laminate materials simultaneously increase μ and ϵ, reducing antenna size, Apr. 11, 2019, Microwave Journal (Year : 2019).*

(Continued)

*Primary Examiner* — Ab Salam Alkassim, Jr.
*Assistant Examiner* — Anh N Ho
(74) *Attorney, Agent, or Firm* — The Small Patent Law Group LLC; Joseph M. Butscher

(57) ABSTRACT

An antenna assembly includes a first magnetic substrate having a first surface and a second surface opposite from the first surface. One or more antenna elements are disposed on the first surface of the first magnetic substrate. A microstrip feed line is disposed on the second surface of the first magnetic substrate. A second magnetic substrate is secured to the first magnetic substrate. The second magnetic substrate includes one or more cavities aligned with the one or more antenna elements and the microstrip feed line.

20 Claims, 5 Drawing Sheets

(56) References Cited

U.S. PATENT DOCUMENTS

| | | | | |
|---|---|---|---|---|
| 6,791,496 | B1 * | 9/2004 | Killen | H01Q 1/38 343/846 |
| 7,436,361 | B1 * | 10/2008 | Paulsen | H01Q 21/0043 343/771 |
| 10,522,916 | B2 * | 12/2019 | Rogers | H01Q 9/045 |
| 10,938,120 | B2 * | 3/2021 | Rogers | H01Q 1/247 |
| 11,067,465 | B2 * | 7/2021 | Rogers | G01L 19/083 |
| 11,069,953 | B2 * | 7/2021 | Rogers | H01Q 9/0428 |
| 2004/0189527 | A1 * | 9/2004 | Killen | H01Q 9/0414 343/770 |
| 2015/0303576 | A1 * | 10/2015 | Latrach | H01Q 9/0464 343/700 MS |
| 2016/0141754 | A1 * | 5/2016 | Leyh | H01Q 21/0075 342/372 |
| 2021/0135368 | A1 * | 5/2021 | Rogers | H01Q 9/0457 |

OTHER PUBLICATIONS

Pozar, D.M., "Microstrip antenna aperture-coupled to a microstrip line," Electronics Letters, Jan. 1985.

Pozar, D.M., Kaufman, B., "Increasing the bandwidth of a microstrip antenna by proximitycoupling," Electronics Letters, Apr. 1987.

P. J., Harackiewicz, F. J.,"Magnetic tuning of a microstrip patch antenna fabricated on a ferrite film," IEEE Microwave and Guided Wave Letters, Dec. 1992.

Papapolymerou, I., et al., "Micromachined patch antennas," IEEE Transactions on Antennas and Propagation, Feb. 1998.

Gauthier, G.P., et al., "A 94 GHz aperture-coupled micromachined microstrip antenna," IEEE Transactions on Antennas and Propagation, Dec. 1999.

Sun, N. X., et al., "Electronically tunable magnetic patch antennas with metal magnetic films," Electronics Letters, Apr. 2007.

Yang, G. M., et al., "Tunable miniaturized patch antennas with self-biased multilayer magnetic films," IEEE Transactions on Antennas and Propagation, Jul. 2009.

* cited by examiner

LOW-PROFILE MAGNETIC ANTENNA ASSEMBLIES

CROSS-REFERENCE TO RELATED APPLICATIONS

This application relates to and claims priority benefits from U.S. Provisional Application No. 63/133,307, entitled "Low-Profile Magnetic Antenna Assemblies," filed Jan. 2, 2021, which is hereby incorporated by reference in its entirety.

FIELD OF EMBODIMENTS OF THE DISCLOSURE

Embodiments of the present disclosure generally relate to antenna assemblies, and more particularly, to low-profile magnetic antenna assemblies.

BACKGROUND OF THE DISCLOSURE

An antenna typically includes an array of conductors electrically connected to an electronic receiver or a transmitter. An electronic transmitter provides a time-varying voltage to terminals of the antenna, which, in response, radiates electromagnetic radio waves at a frequency corresponding to the time-varying voltage. Alternatively, as radio waves are received by the antenna, a time-varying voltage corresponding to the frequency of the radio wave is generated at the terminals, which, in turn is provided to the electronic receiver. Various types of known passive antennas are configured to transmit and receive radio waves equivalently with such a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

Various known planar antennas that include microstrip feeds and pin feeds exhibit low bandwidth, due to their narrowband impedance matching. However, the bandwidth can be increased by using a proximity-coupled feed line. Still, planar antennas generally have low gain and bandwidth due to their thin nature. Further, antennas operating at low frequencies (for example, less than 500 MHz) are typically large (in both height and area), as antenna size scales inversely with frequency.

SUMMARY OF THE DISCLOSURE

A need exists for a microstrip-based antenna that exhibits increased or otherwise improved gain and bandwidth, and with reduced size.

With that need in mind, certain embodiments of the present disclosure provide an antenna assembly including a first magnetic substrate having a first surface and a second surface opposite from the first surface. One or more antenna elements are disposed on the first surface of the first magnetic substrate. A microstrip feed line is disposed on the second surface of the first magnetic substrate. A second magnetic substrate is secured to the first magnetic substrate. The second magnetic substrate includes one or more cavities aligned with the one or more antenna elements and the microstrip feed line.

In at least one embodiment, a ground plane is connected to the second magnetic substrate. The one or more cavities are disposed between the one or more antenna elements and the ground plane. In at least one embodiment, the microstrip feed line is disposed between the one or more antenna elements and the one or more cavities.

In at least one embodiment, the antenna assembly further includes a third magnetic substrate. The third magnetic substrate is secured to the second magnetic substrate.

In at least one embodiment, the antenna assembly is devoid of electrical vias.

The second magnetic substrate may be secured to the first magnetic substrate by a first laminate layer.

In at least one embodiment, the second magnetic substrate has a first surface and a second surface opposite from the first surface. The one or more cavities extend through and between the first surface and the second surface of the second magnetic substrate.

As an example, the one or more antenna elements are one or more rectangular patch antenna elements having inclusive slots.

In at least one embodiment, the one or more cavities extend below the one or more antenna elements and the microstrip feed line. In at least one embodiment, the one more cavities define an axial envelope that contains the one or more antenna elements and the microstrip feed line.

The first magnetic substrate and the second magnetic substrate have a magnetic permeability greater than 1. As an example, the first magnetic substrate and the second magnetic substrate have a dielectric permittivity of at least 6 and a magnetic permeability of at least 6.

Certain embodiments of the present disclosure provide a method of forming an antenna assembly. The method includes disposing one or more antenna elements on a first surface of a first magnetic substrate; disposing a microstrip feed line on a second surface of the first magnetic substrate, wherein the second surface is opposite from the first surface; forming one or more cavities in a second magnetic substrate; and securing the second magnetic substrate to the first magnetic substrate. Said securing includes aligning the one or more cavities with the one or more antenna elements and the microstrip feed line.

In at least one embodiment, the method also includes connecting a ground plane to the second magnetic substrate. Said connecting includes disposing the one or more cavities between the one or more antenna elements and the ground plane. Said connecting may also include disposing the microstrip feed line between the one or more antenna elements and the one or more cavities.

As an example, said securing includes securing the second magnetic substrate to the first magnetic substrate by a first laminate layer.

In at least one embodiment, said securing includes containing one or more antenna elements and the microstrip feed line within an axial envelope defined by the one more cavities.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a low-profile magnetic antenna assembly with cavity backing. The antenna assembly has at least one proximity-coupled antenna element on a top surface of a composite magnetic radio frequency (RF) board, an embedded microstrip feed line below or within the RF board, a ground plane on the backside or bottom surface of the RF board, and a cavity between the antenna element and ground plane. The use of a magnetic substrate significantly reduces the size of the antenna assembly by utilizing a magnetic permeability $\mu_r>1$, in contrast to a dielectric substrate that has a $\mu_r=1$. The ground plane minimizes or otherwise reduces any change in antenna behavior while the antenna assembly is placed on conductive surfaces (for example, wings, fuselage, tail fin, and the like of an aircraft).

The antenna assembly according to embodiments of the present disclosure includes one or more antenna elements (such as rectangular patch antenna assemblies having inclusive slots) electrically coupled to an embedded microstrip feed, which minimizes or otherwise reduces power loss and simplifies planar arraying. The antenna assembly also includes a ground plane to minimize or otherwise reduce any change in electrical behavior due to conductive surfaces. The antenna assembly utilizes one or more magnetic substrates or layers (such as one more magnetic RF boards) to reduce antenna size (both height and area) and weight. One or more cavities are formed between the one or more antenna elements and the ground plane, which thereby improves the gain of the antenna assembly.

The antenna assembly is efficiently manufacturable. For example, the antenna assembly does not need any electrical vias. That is, the antenna assembly may be devoid of electrical vias. The antenna assembly can be manufactured using subtractive (for example, laser etch, milling, and/or wet etching) or additive (for example, printing and/or film deposition) methods.

Figure 1:
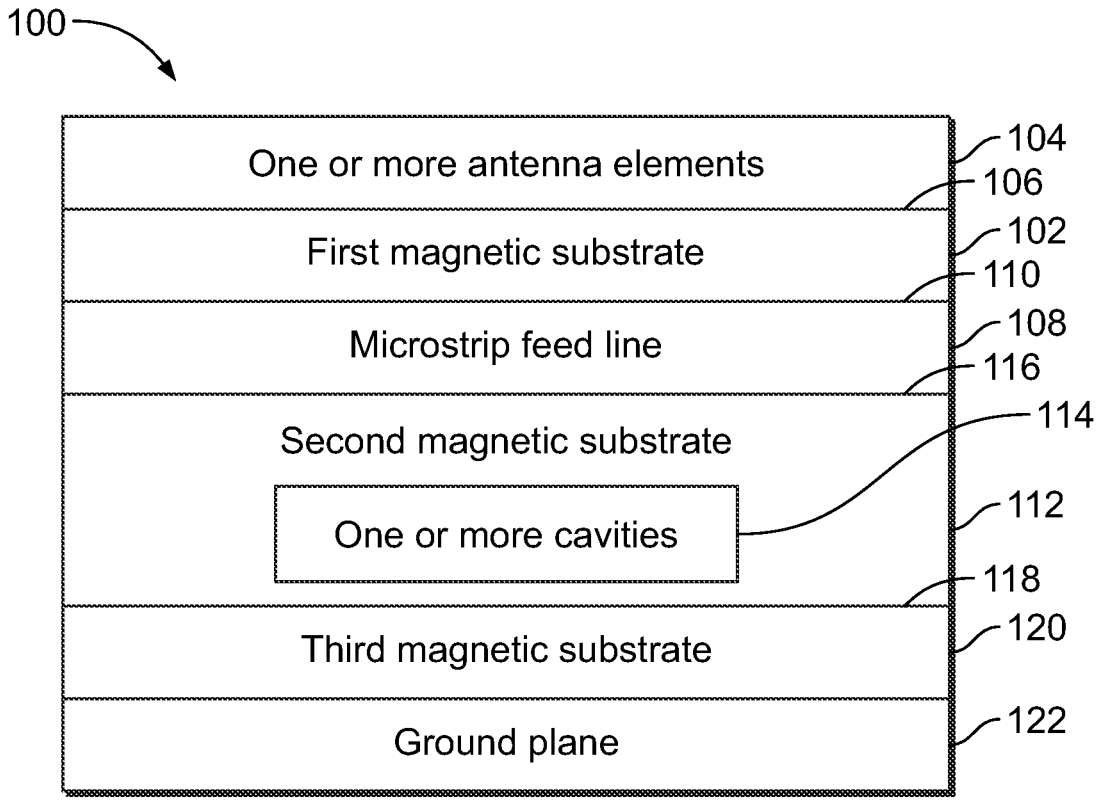
FIG. 1 illustrates a schematic block diagram of an antenna assembly, according to an embodiment of the present disclosure.

FIG. 1 illustrates a schematic block diagram of an antenna assembly 100, according to an embodiment of the present disclosure. The antenna assembly 100 includes a first magnetic substrate 102. One or more antenna elements 104 are disposed on a first surface 106 of the first magnetic substrate 102. A microstrip feed line 108 is disposed on a second surface 110 of the first magnetic substrate 102. The second surface 110 is opposite from the first surface 106. For example, the first surface 106 may be a top surface, and the second surface 110 may be a bottom surface.

The antenna assembly 100 includes a second magnetic substrate 112 secured to the first magnetic substrate 102. For example, the second magnetic substrate 112 may be secured to the first magnetic substrate 102 through a laminate layer. The second magnetic substrate 112 includes one or more cavities (or air gaps) 114. In at least one embodiment, the one or more cavities 114 extend through and between a first surface 116 and a second surface 118 of the second magnetic substrate 112. The first surface 116 is opposite from the second surface 118. For example, the first surface 116 may be a top surface, and the second surface 118 may be a bottom surface. Optionally, the one or more cavities 114 may be contained within the second magnetic substrate 112, such as between the first surface 116 and the second surface 118.

A third magnetic substrate 120 is secured to the second magnetic substrate 112. For example, the third magnetic substrate 120 may be secured to the second surface 118 of the second magnetic substrate 112 through a laminate layer.

A ground plane 122 is secured to the third magnetic substrate 120. For example, the ground plane 122 is secured below the third magnetic substrate 120. Alternatively, the antenna assembly 100 may not include the third magnetic substrate 120. Instead, the ground plane 122 may be secured to the second magnetic substrate 112.

The one or more cavities 114 are disposed between the one or more antenna elements 104 and the ground plane 122. For example, the one or more cavities 114 are disposed underneath the one or more antenna elements 104 and above the ground plane 122. Further, the one or more cavities 114 are disposed underneath the microstrip feed line 108.

In at least one embodiment, the one or more cavities 114 are aligned with the one or more antenna elements 104. In at least one embodiment, the one or more antenna elements 104 and the microstrip feed line 108 are above the one or more cavities 114. The one or more antenna elements 104 are not within the one or more cavities 114. Instead, the one or more antenna elements 104 are aligned over, above, or the like from the one or more cavities 114.

The first magnetic substrate 102, the second magnetic substrate 112, and the third magnetic substrate 120 provide magnetic layers. For example, one or more of the first magnetic substrate 102, the second magnetic substrate 112, and the third magnetic substrate 120 may include magnetic filler sandwiched between metallic (such as copper) plates or sheets. In contrast to a dielectric substrate, which has a magnetic permeability $\mu_r=1$, the first magnetic substrate 102, the second magnetic substrate 112, and the third magnetic substrate 120 have a magnetic permeability $\mu_r>1$.

The one or more antenna elements 104 are proximity-coupled (or electrically coupled) to the microstrip feed line 108. The body of the first magnetic substrate 102 separates the one or more antenna elements 104 from the microstrip feed line 108. In at least one embodiment, the microstrip feed line 108 may be embedded within the first magnetic substrate 102 between the first surface 106 and the second surface 110.

By using one or more magnetic substrates (such as the first magnetic substrate 102, the second magnetic substrate 112, and the third magnetic substrate 120) instead of dielectric substrates, the overall size of the antenna assembly 100 is significantly reduced. As such, the antenna assembly 100 has a lower profile, and is both smaller and lighter than if dielectric layers were used. The ground plane 122 minimizes or otherwise reduces any change in antenna behavior while the antenna assembly 100 is placed on conductive surfaces (for example, wings, fuselage, tail fin, and the like of an aircraft).

The antenna assembly according to embodiments of the present disclosure includes one or more antenna elements 104 (such as rectangular patch antenna assemblies having inclusive slots) electrically coupled to an embedded microstrip feed line 108 (such as between the first magnetic substrate 102 and the second magnetic substrate 112), which minimizes or otherwise reduces power loss and simplifies planar arraying. It has been found that the one or more cavities 114 within the second magnetic substrate 112 between the one or more antenna elements 104 and the ground plane 122 improve the gain of the antenna assembly 100.

In at least one embodiment, the antenna assembly 100 is devoid of electrical vias. As such, the process of manufacturing the antenna assembly 100 may be easier due to there being no need to form electrical vias within the antenna assembly 100. Alternatively, the antenna assembly 100 may include at least one electrical via.

The one or more antenna elements 104 may include an inclusive slot. For example, the one more antenna elements 104 may be a rectangular patch antenna element having an inclusive slot. The inclusive slot improves cross polarization of the antenna assembly 100. Alternatively, the one or more antenna elements 104 may not include inclusive slots. As another example, the one or more antenna elements 104 may be circular antenna elements that may or may not include inclusive slots.

As described herein, the antenna assembly 100 includes the first magnetic substrate 102 having the first surface 106 and the second surface 110 opposite from the first surface 106. The one or more antenna elements 104 are disposed on the first surface 106 of the first magnetic substrate 102. The microstrip feed line 108 is disposed on the second surface 110 of the first magnetic substrate 102. The second magnetic substrate 112 is secured to the first magnetic substrate 102. The second magnetic substrate 112 includes the one or more cavities 114 aligned with the one or more antenna elements 104 and the microstrip feed line 108. For example, the one or more cavities 114 are below the one or more antenna elements 104 and the microstrip feed line 108.

In at least one embodiment, the ground plane 122 is connected to the second magnetic substrate 112. The one or more cavities 114 are disposed between the one or more antenna elements 104 and the ground plane 122. In at least one embodiment, the microstrip feed line 108 is disposed between the one or more antenna elements 104 and the one or more cavities 114.

The antenna assembly 100 may also include the third magnetic substrate 120. For example, the ground plane 122 is secured to the third magnetic substrate 120. The third magnetic substrate 120 is further secured to the second magnetic substrate 112.

It is to be understood that the terms first, second, third, fourth, and the like are merely for labeling purposes. A "first," may be a "second," "third," "fourth," or vice versa.

Figure 2:
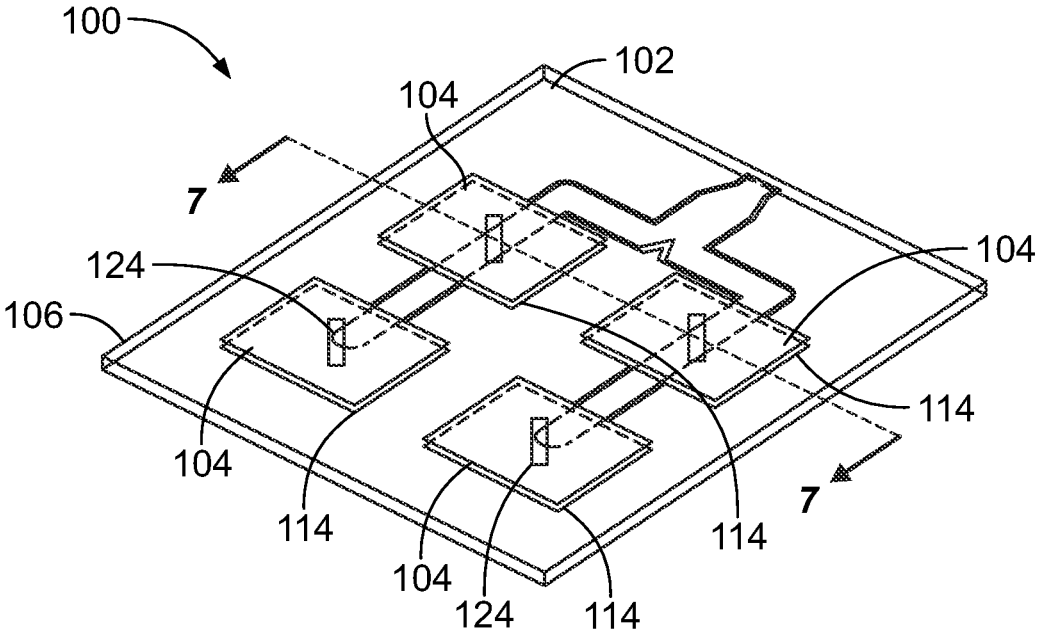
FIG. 2 illustrates a perspective top view of the antenna assembly, according to an embodiment of the present disclosure.
Figure 3:
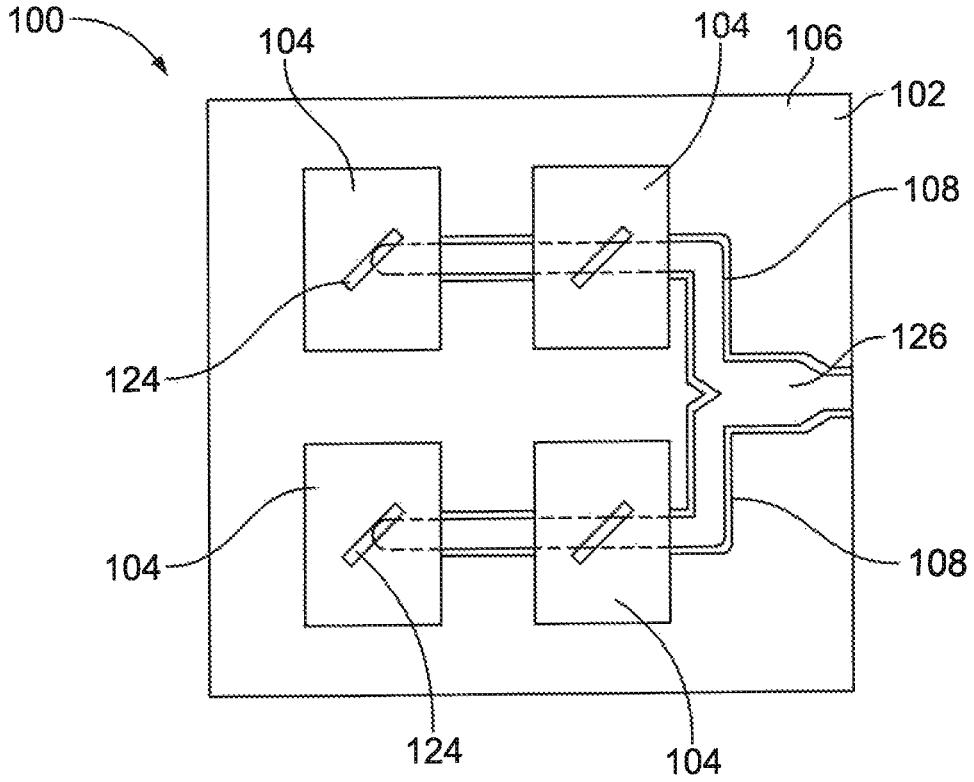
FIG. 3 illustrates a top view of the antenna assembly of FIG. 2.

FIG. 2 illustrates a perspective top view of the antenna assembly 100, according to an embodiment of the present disclosure. FIG. 3 illustrates a top view of the antenna assembly 100 of FIG. 2. Referring to FIGS. 2 and 3, for the sake of clarity, portions of the antenna assembly 100 are shown transparent.

As shown, the antenna assembly 100 includes four antenna elements 104 disposed above four cavities 114, respectively. Optionally, the antenna assembly 100 can include more or less antenna elements 104 disposed above more or less cavities 114. The antenna elements 104 are not within the cavities 114. Rather, the antenna elements 104 are disposed above the cavities 114, as described above.

The antenna elements 104 can include inclusive slots 124, which improve the cross polarization of the antenna assembly 100. Optionally, less than all of the antenna elements 104 include inclusive slots 124. Alternatively, none of the antenna elements 104 include inclusive slots 124.

The microstrip feed line 108 connects to a power divider 126, such as in an edge-to-edge fashion. In at least one embodiment, a single contiguous cavity 114 is disposed below the microstrip feed line 108, the antenna elements 104, and the power divider 126. Optionally, separate and distinct cavities 114 may be disposed below the antenna elements 104 and portions of the microstrip feed line 108 and/or the power divider 126.

In at least one embodiment, the one or more cavities 114 extend below the antenna elements 104, the microstrip feed line 108, and the power divider 126 outside of the widths, diameters, or axial envelopes of the one or more antenna elements 104. For example, the one or more cavities 114 may extend below an entirety of the antenna elements 104, the microstrip feed line 108 and the power divider 126.

The antenna assembly 100 shown in FIGS. 2 and 3 is merely exemplary and includes the antenna elements 104 arranged in a 2×2 array. The antenna elements 104 are disposed on the first (for example, top) surface 106 of the first magnetic substrate 102. The microstrip feed line 108 is embedded within the antenna assembly 100, such as between the first magnetic substrate 102 and the second magnetic substrate 112 (shown in FIG. 1). The dimensions of the antenna assembly 100 (for example, length, width, slot length, slot width, and the like) including the one or more cavities 114 (for example, length, width, height, and the like) are numerically determined to maximize or otherwise increase signal propagation at a desired operating frequency.

The antenna assembly 100 may include more or less antenna elements 104 than shown. For example, the antenna assembly 100 may include a single antenna element 104. As another example, the antenna assembly 100 may include two antenna elements 104. As another example, the antenna assembly 100 may include eight or more antenna elements 104.

Figure 4:
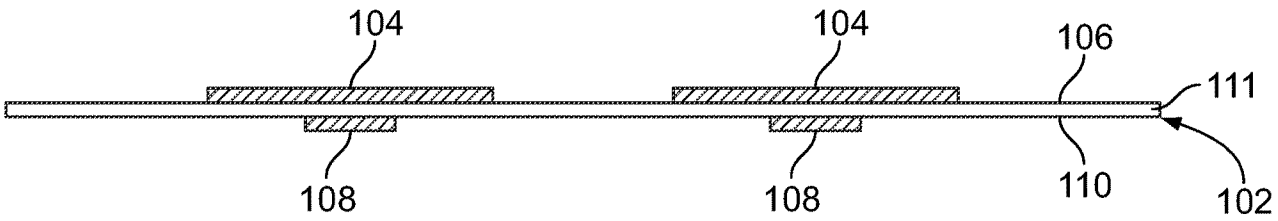
FIG. 4 illustrates a cross-sectional view of antenna elements and a microstrip feed line disposed on a first magnetic substrate through line 7-7 of FIG. 2.

FIG. 4 illustrates a cross-sectional view of the antenna elements 104 and the microstrip feed line 108 disposed on the first magnetic substrate 102 through line 7-7 of FIG. 2. The antenna elements 104 are disposed on the first surface 106 of the first magnetic substrate 102. The microstrip feed line 108 is disposed on the second surface 110 of the first magnetic substrate 102. As shown, the microstrip feed line 108 is disposed underneath the antenna elements 104. The body 111 of the first magnetic substrate 102 separates the antenna elements 104 from the microstrip feed line 108. The antenna elements 104 and the microstrip feed line 108 may be formed of an electrically conductive material, such as silver or copper, and may be additively formed on the first magnetic substrate 102, such as through printing or film deposition. Additionally, the electrically conductive material may be subtractively formed, such as through laser etching, milling, wet etching, or the like.

Figure 5:
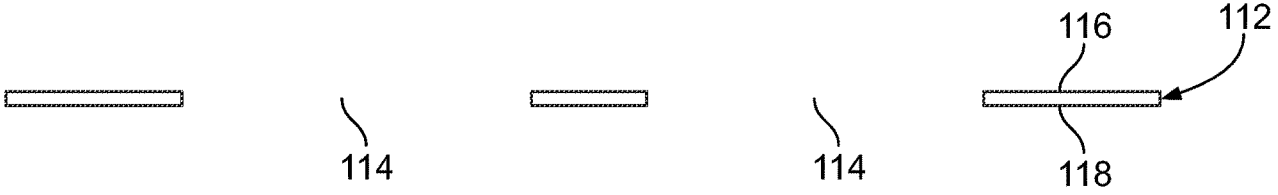
FIG. 5 illustrates a cross-sectional view of a second magnetic substrate through line 7-7 of FIG. 2.

FIG. 5 illustrates a cross-sectional view of the second magnetic substrate 112 through line 7-7 of FIG. 2. As shown, the cavities 114 may extended between and through the first surface 116 and the second surface 118 of the second magnetic substrate 112. The cavities 114 may be subtractively formed, such as through laser etching, milling, wet etching, or the like.

Figure 6:
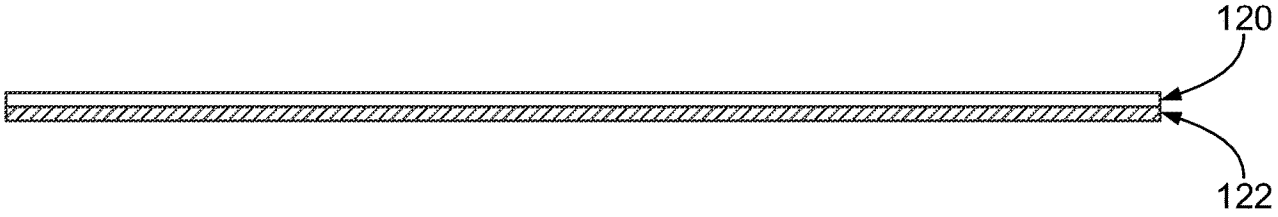
FIG. 6 illustrates a ground plane disposed on a third magnetic substrate through line 7-7 of FIG. 2.

FIG. 6 illustrates the ground plane 122 disposed on the third magnetic substrate 120 through line 7-7 of FIG. 2. The ground plane 122 may be an electrically conductive material, such as silver or copper. The ground plane 122 may be additively or subtractively formed on the third magnetic substrate 120.

Figure 7:
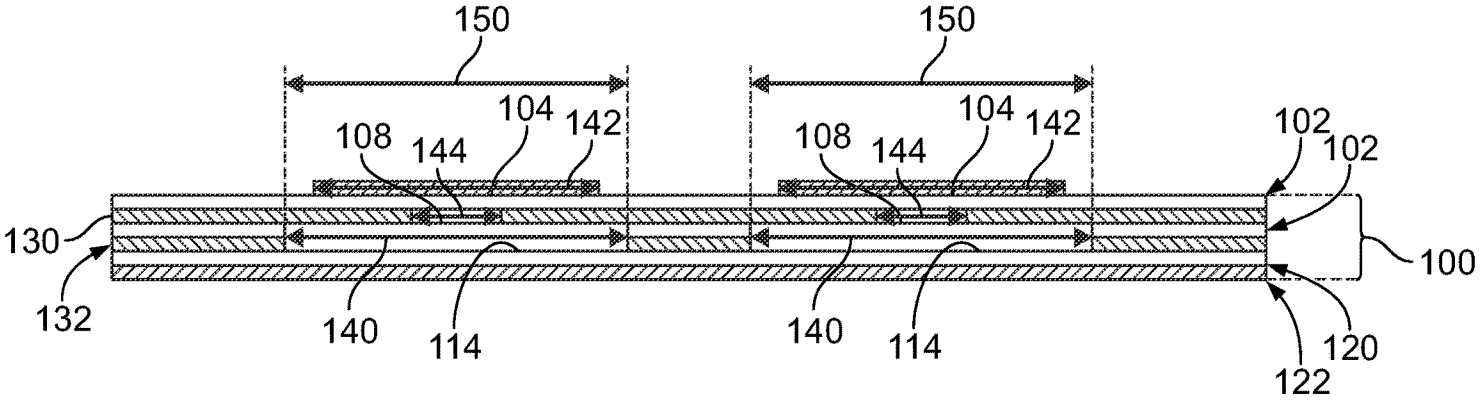
FIG. 7 illustrates a cross-sectional view of the antenna assembly through line 7-7 of FIG. 2.

FIG. 7 illustrates a cross-sectional view of the antenna assembly 100 through line 7-7 of FIG. 2. As shown, a first laminate layer 130 may secure the first magnetic substrate 102 to the second magnetic substrate 112. Further, a second laminate layer 132 may secure the second magnetic substrate 112 to the third magnetic substrate 120.

The cavities 114 are formed underneath the antenna elements 104 and the microstrip feed line 108. The cavities 114 have a width or diameter 140 that is greater that a width or diameter 142 of the antenna elements 104 and a width 144 of the microstrip feed line 108. As such, the cavities 114 define an axial envelope 150 that contains the antenna elements 104 and the microstrip feed line 108.

Figure 8:
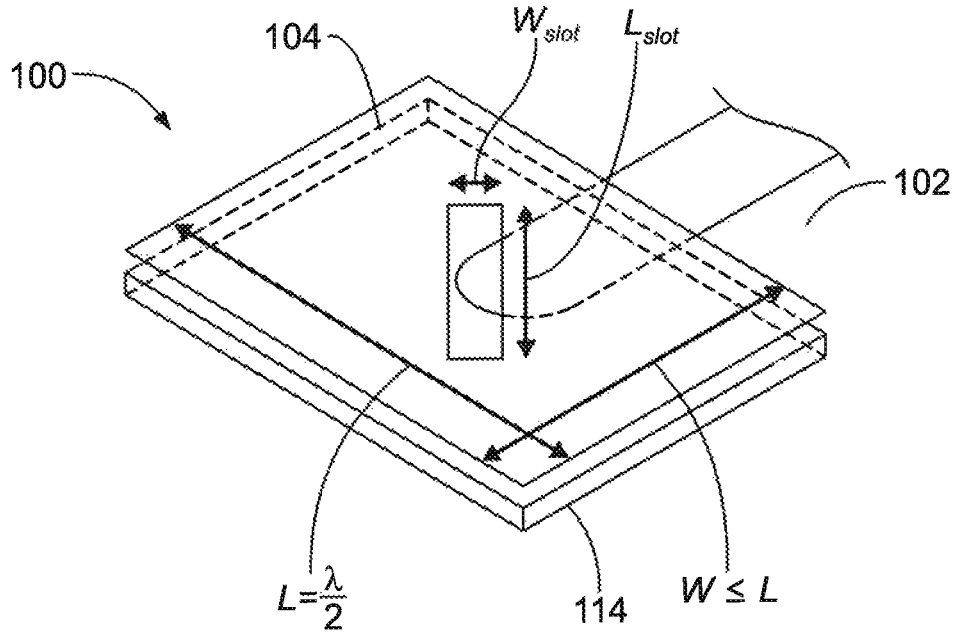
FIG. 8 illustrates a perspective top view of an antenna element disposed on the first magnetic substrate of the antenna assembly.

FIG. 8 illustrates a perspective top view of an antenna element 104 disposed on the first magnetic substrate 102 of the antenna assembly 100. The first mode (resonant frequency) of a rectangular antenna element 104 is proportional to the length, L, of the antenna element 104. As noted, a dielectric substrate (in contrast to a magnetic substrate) has a permeability $(\mu_r)=1$, which results in:

$$\lambda=c/f\sqrt{\varepsilon_r}$$

Where $\lambda$ is the wavelength of a frequency within an a dielectric substrate, and $\varepsilon_r$ is the dielectric permittivity of the substrate. In contrast, a magnetic substrate, such as including the first magnetic substrate 102, has a magnetic permeability greater than 1 (that is, $\mu_r>1$), which results in $$\lambda=c/f\sqrt{\varepsilon_r\mu_r}$$

Where $\mu_r$ is the magnetic permeability of the magnetic substrate. The permittivity for a magnetic substrate with a magnetic permittivity greater than 1 is effectively scaled up by a factor of $\mu_r$. For example, a magnetic substrate with a magnetic permittivity of 6 and permeability of 6 has a permittivity effectively six times greater than a dielectric material with a permittivity of 6.

Referring to FIGS. 1-8, the first magnetic substrate 102, the second magnetic substrate 112, and the third magnetic substrate 120 have a magnetic permeability of $\mu_r>1$. In at least one embodiment, the first magnetic substrate 102, the second magnetic substrate 112, and the third magnetic substrate have a magnetic permittivity of at least 6 and a magnetic permeability of at least 6, thereby providing an effective permittivity of at least 36.

Figure 9:
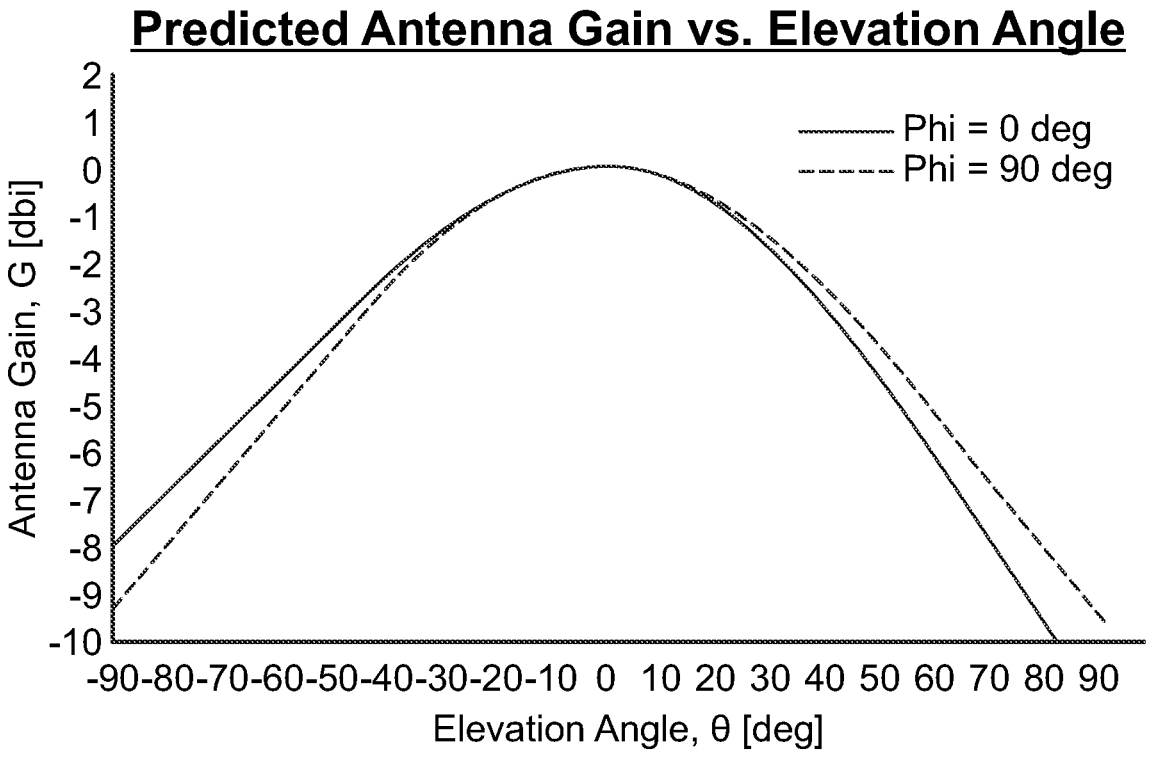
FIG. 9 illustrates a graph of predicted antenna gain in relation to elevation angle for the antenna assembly.
Figure 10:
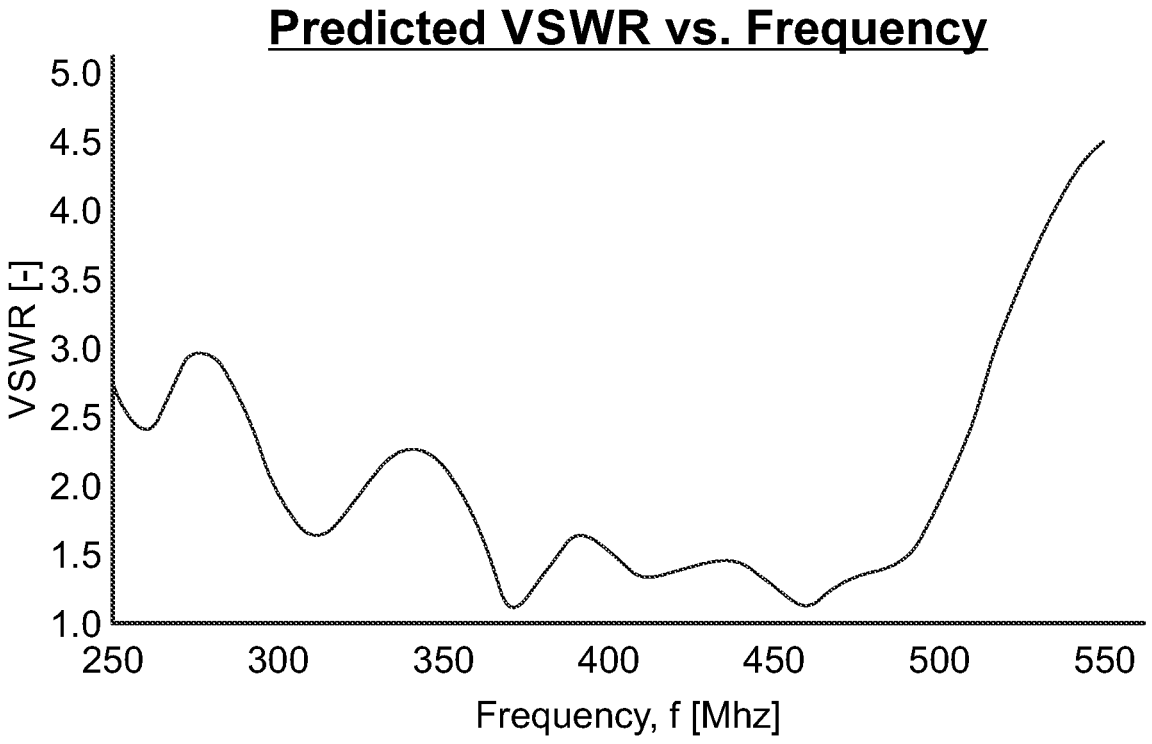
FIG. 10 illustrates a graph of predicted voltage standing wave ratio (VSWR) in relation to frequency for the antenna assembly.

FIG. 9 illustrates a graph of predicted antenna gain in relation to elevation angle for the antenna assembly 100 shown and described with respect to FIGS. 1-8. FIG. 10 illustrates a graph of predicted voltage standing wave ratio (VSWR) in relation to frequency for the antenna assembly 100. Referring to FIGS. 9 and 10, a numerical model of a low-profile magnetic cavity backed antenna in a 2×2 array designed to operate near 350 MHz was developed using a finite element method (FEM) solver to predict the performance. It has been found that such an antenna assembly 100 has an antenna gain of 0.36 dBi with a 3 dB beamwidth of 97 deg. The 2:1 VSWR bandwidth of the antenna is ~145 MHz or 41%.

Figure 11:
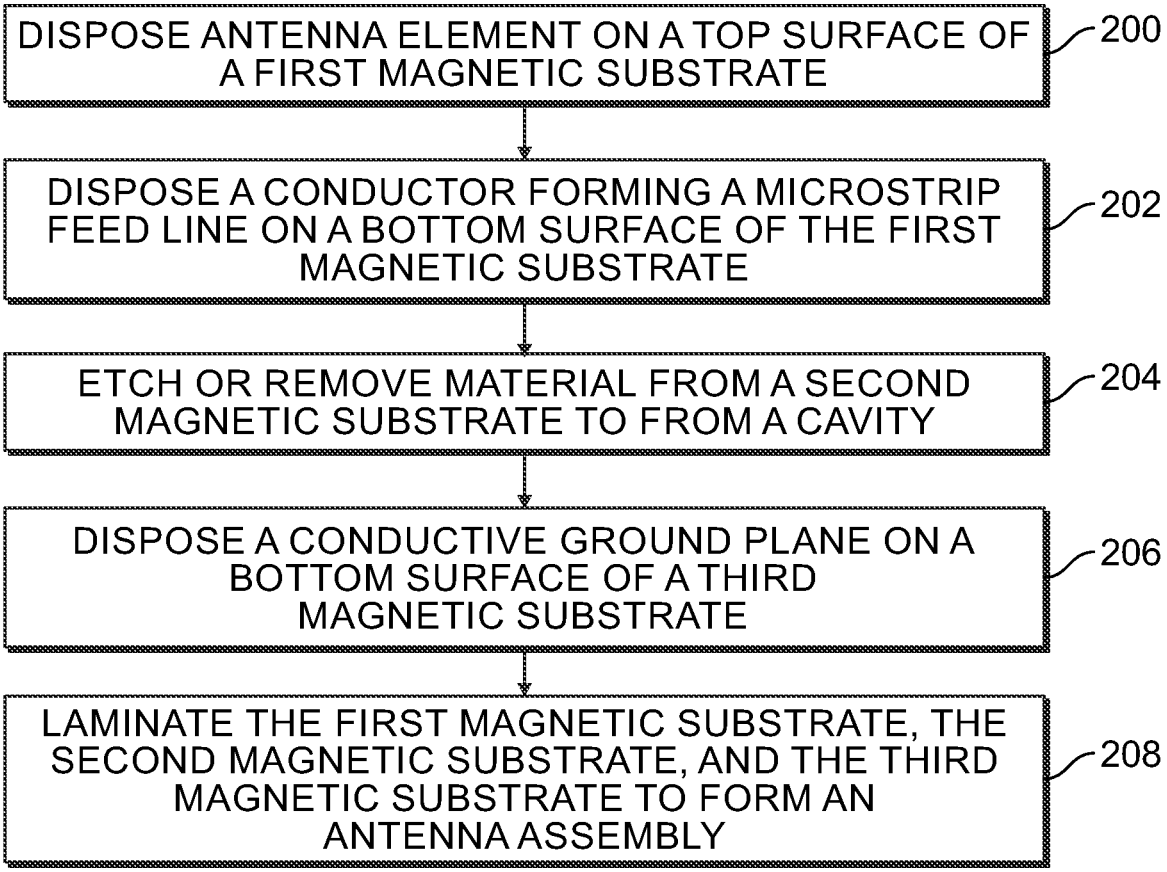
FIG. 11 illustrates a flow chart of a method of forming an antenna assembly, according to an embodiment of the present disclosure.

FIG. 11 illustrates a flow chart of a method of forming an antenna assembly, according to an embodiment of the present disclosure. Referring to FIGS. 1-11, at 200, an antenna element 104 is disposed on a first surface 106 (such as a top surface) of the first magnetic substrate 102. At 202, a conductor forming the microstrip feed line 108 is disposed on the second surface 110 (such as a bottom surface) of the first magnetic substrate 102. At 204, material is etched or otherwise removed from the second magnetic substrate 112 to form a cavity 114. At 206, a conductive material forming the ground plane 122 is disposed on a bottom surface of the third magnetic substrate 120. At 208, the first magnetic substrate, the second magnetic substrate, and the third magnetic substrate 120 are laminated together to form the antenna assembly 100.

As described herein, embodiments of the present disclosure provide microstrip-based antenna assemblies having improved characteristics, such as increased or otherwise improved gain and bandwidth, and having reduced antenna size.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly comprising:

a first magnetic substrate having a first surface and a second surface opposite from the first surface;

one or more antenna elements disposed on the first surface of the first magnetic substrate;

a microstrip feed line disposed on the second surface of the first magnetic substrate;

a second magnetic substrate secured to the first magnetic substrate, wherein the second magnetic substrate comprises one or more cavities aligned with the one or more antenna elements and the microstrip feed line;

a ground plane connected to the second magnetic substrate, wherein the one or more cavities are disposed between the one or more antenna elements and the ground plane.

2. The antenna assembly of claim 1, wherein the microstrip feed line is disposed between the one or more antenna elements and the one or more cavities.

3. The antenna assembly of claim 1, further comprising a third magnetic substrate, and wherein the third magnetic substrate is secured to the second magnetic substrate.

4. The antenna assembly of claim 1, wherein the antenna assembly is devoid of electrical vias.

5. The antenna assembly of claim 1, wherein the second magnetic substrate is secured to the first magnetic substrate by a first laminate layer.

6. The antenna assembly of claim 1, wherein the second magnetic substrate has a first surface and a second surface opposite from the first surface, wherein the one or more cavities extend through and between the first surface and the second surface of the second magnetic substrate.

7. The antenna assembly of claim 1, wherein the one or more antenna elements are one or more rectangular patch antenna elements having inclusive slots.

8. The antenna assembly of claim 1, wherein the one or more cavities extend below the one or more antenna elements and the microstrip feed line.

9. The antenna assembly of claim 1, wherein the one more cavities define an axial envelope that contains the one or more antenna elements and the microstrip feed line.

10. The antenna assembly of claim 1, wherein the first magnetic substrate and the second magnetic substrate have a magnetic permeability greater than 1.

11. The antenna assembly of claim 1, wherein the first magnetic substrate and the second magnetic substrate have a magnetic permittivity of at least 6 and a magnetic permeability of at least 6.

12. A method of forming an antenna assembly, the method comprising:

disposing one or more antenna elements on a first surface of a first magnetic substrate;

disposing a microstrip feed line on a second surface of the first magnetic substrate, wherein the second surface is opposite from the first surface;

forming one or more cavities in a second magnetic substrate;

securing the second magnetic substrate to the first magnetic substrate, wherein said securing comprises aligning the one or more cavities with the one or more antenna elements and the microstrip feed line; and connecting a ground plane to the second magnetic substrate, wherein said connecting comprises disposing the one or more cavities between the one or more antenna elements and the ground plane.

13. The method of claim 12, wherein the second magnetic substrate has a first surface and a second surface opposite from the first surface, wherein the one or more cavities extend through and between the first surface and the second surface of the second magnetic substrate.

14. The method of claim 13, wherein said connecting further comprises disposing the microstrip feed line between the one or more antenna elements and the one or more cavities.

15. The method of claim 12, wherein said securing comprises securing the second magnetic substrate to the first magnetic substrate by a first laminate layer.

16. The method of claim 12, wherein said securing comprises containing one or more antenna elements and the microstrip feed line within an axial envelope defined by the one or more cavities.

17. An antenna assembly comprising:

a first magnetic substrate having a first surface and a second surface opposite from the first surface;

one or more antenna elements disposed on the first surface of the first magnetic substrate;

a microstrip feed line disposed on the second surface of the first magnetic substrate;

a second magnetic substrate secured to the first magnetic substrate by a first laminate layer, wherein the second magnetic substrate comprises one or more cavities aligned with the one or more antenna elements and the microstrip feed line, and wherein the one or more cavities define an axial envelope that contains the one or more antenna elements and the microstrip feed line;

a third magnetic substrate secured to the second magnetic substrate by a second laminate layer; and a ground plane secured to the third magnetic substrate, wherein the one or more cavities are disposed between the one or more antenna elements and the ground plane, wherein the microstrip feed line is disposed between the one or more antenna elements and the one or more cavities.

18. The antenna assembly of claim 17, wherein the first magnetic substrate and the second magnetic substrate have a magnetic permeability greater than 1.

19. The antenna assembly of claim 17, wherein the first magnetic substrate and the second magnetic substrate have a magnetic permittivity of at least 6 and a magnetic permeability of at least 6.

20. An antenna assembly comprising:

a first magnetic substrate having a first surface and a second surface opposite from the first surface;

one or more antenna elements disposed on the first surface of the first magnetic substrate;

a microstrip feed line disposed on the second surface of the first magnetic substrate; and a second magnetic substrate secured to the first magnetic substrate, wherein the second magnetic substrate comprises one or more cavities aligned with the one or more antenna elements and the microstrip feed line, wherein the second magnetic substrate has a first surface and a second surface opposite from the first surface, wherein the one or more cavities extend through and between the first surface and the second surface of the second magnetic substrate.

* * * * *